US005148080A

United States Patent [19]

Van Thyne

[11] Patent Number: 5,148,080

[45] Date of Patent: Sep. 15, 1992

[54] INCANDESCENT LAMP FILAMENT INCORPORATING HAFNIUM

[75] Inventor: Ray J. Van Thyne, Inverness, Ill.

[73] Assignee: Hilux Development, Alsip, Ill.

[21] Appl. No.: 465,415

[22] Filed: Jan. 16, 1990

[51] Int. Cl.[5] ..... H01J 1/14

[52] U.S. Cl. ..... 313/345

[58] Field of Search ..... 313/341-345

[56] References Cited

U.S. PATENT DOCUMENTS

| | | | |
|---|---|---|---|
| 1,631,493 | 6/1927 | Laise . | |
| 3,287,591 | 11/1966 | Sloan | 313/345 X |
| 3,346,761 | 10/1967 | Ackerman | 313/344 X |
| 3,443,143 | 5/1969 | Koo | 313/311 |
| 3,486,063 | 12/1969 | Ruben | 313/222 |
| 3,531,678 | 9/1970 | Schiavone | 313/345 X |
| 3,679,494 | 7/1972 | Hill et al. | 148/20.3 |
| 3,821,585 | 6/1974 | Jansson et al. | 313/178 |
| 3,829,731 | 8/1974 | T'Jampens et al. | 313/174 |
| 3,927,989 | 12/1975 | Koo | 252/515 X |
| 4,017,758 | 4/1977 | Almer et al. | 313/112 |
| 4,039,878 | 8/1977 | Eijkelenboom et al. | 313/113 |
| 4,097,221 | 6/1978 | Shaffer et al. | 431/95 R |
| 4,305,017 | 12/1981 | Kuus et al. | 313/174 |

FOREIGN PATENT DOCUMENTS

82/03138 9/1982 PCT Int'l Appl. .

*Primary Examiner*—Sandra L. O'Shea
*Attorney, Agent, or Firm*—Emrich & Dithmar

[57] ABSTRACT

The lamp filament has a substoichiometric nitrided surface layer containing hafnium or hafnium alloy which exhibits higher emissivity in the visible light spectrum. The filament is made by providing a metallic wire containing hafnium, shaping the wire into a filament and then reacting the filament in an atmosphere containing hydrogen.

27 Claims, No Drawings

INCANDESCENT LAMP FILAMENT INCORPORATING HAFNIUM

BACKGROUND OF THE INVENTION

Improved ductile tungsten filament incandescent lamps were introduced in 1911 by General Electric Company. Their original efficiency was approximately 10 lumens (a unit of light measurement) per watt. Between 1911 and 1936 a new coiled coil design and the use of gas filling increased the efficiency to 17 lumens per watt for a 100 watt bulb. In the coiled coil filament, wire is formed into a coil about three inches long and then that is coiled; thus, the term "coiled coil" wire. It has long been recognized that the efficiency of an incandescent lamp can be improved substantially. The tungsten filament emits a smaller amount of the energy as visible light. Over 80% is in the infrared and ultraviolet (nonvisible) spectrum.

Since the 1930's, there have been many approaches to the development of an improved tungsten filament that has longer life and higher efficiency. Those developments that have accomplished these goals have been much more expensive than the standard tungsten lamp.

Bell Telephone Laboratories has produced a microscopic texturing of the tungsten surface which greatly enhances the emissivity. However, the microscopic texturing is expected to deteriorate during the operation of a filament at the typical filament temperature of 2675° C.

SUMMARY OF THE INVENTION

It is an important object of the present invention to provide an improved incandescent filament (as used herein, the term "filament" encompasses wire and other shapes, such as ribbon) which is substantially more efficient than currently available tungsten filaments.

It is another object to provide a lamp incorporating such improved filament, at a small increase in cost.

It is another object to provide an incandescent lamp that has generally the same size, shape and weight of existing incandescent lamps and operates at a substantially higher efficiency and costs only slightly more.

Another object is to provide a lamp filament which is readily fabricable prior to nitriding.

In summary, there is provided an incandescent lamp filament having a substoichiometric nitrided surface layer containing hafnium exhibiting higher emissivity in the visible light spectrum.

Also, there is provided a process for making such filament comprising the steps of providing metallic wire containing hafnium, shaping the wire into a filament and then reacting said filament in an atmosphere containing nitrogen.

The invention consists of certain novel features, a composition and a process hereinafter fully described, and particularly pointed out in the appended claims, it being understood that various changes in the details may be made without departing from the spirit, or sacrificing any of the advantages of the present invention.

EXPERIMENTAL PROCEDURES

Temperature measurement of a small diameter incandescent filament with unknown emissivity at high temperatures is a formidable problem. Several different optical instruments were evaluated. Brightness or color temperatures are generally measured without corrections if emissivity is unknown. The Pyro 95 Micro Optical Pyrometer used is capable of high temperature measurement of a 0.001 inch diameter filament. Temperatures measured using the pyrometer are based upon emissivity at 655 nm. Based on several experiments, the measured uncorrected optical temperature of a filament in a commercial 100 watt lamp is about 2300° C.

Lamps containing experimental filaments and a partial nitrogen atmosphere at room temperature were fabricated. G25, G30, and P30 (3.1 inch diameter and 3.8 inch diameter commercial size specifications) lamps have been made, with a vertical U-shaped, $2\frac{7}{8}$ inch long filament. Because the filaments are short and relatively large in cross section, the current is proportionately high. Special techniques, including the use of large diameter lamp posts, were developed to provide adequate current carrying capacity. After some initial lamps were made, the nickel wire for the posts was treated in hydrogen at 900° C. to remove one possible source of contamination. Lamps produced later used hard glass.

A photometric sphere was constructed for light output measurements. It consists of two mating 36 inch diameter fiberglass hemispheres painted on the inside surface with a special optical white paint and black on the outside. The light sensing head of a Photo Research 302 Photometer is located in a port on the spherical chamber. It is protected from reading direct light radiation by a metal shield (covered with the special optical white paint) placed between the lamp and the light sensing port. The lamp is located in the center of the sphere. Light output is measured in foot candles. Using a standard lamp of known lumen output purchased from ETL Laboratories, a calibration of lumens per foot candle is determined for the photometric sphere. This fact is then used to convert experimentally determined foot candles for an unknown lamp to lumens.

To demonstrate the high brightness temperature or emissivity of an experimental material, compared to tungsten, an experiment was devised. A small molybdenum tube was heated by electrical resistance in a nitrogen atmosphere. The tube was in a horizontal position and wires, or ribbons, of tungsten and experimental material were hung vertically in the tube adjacent to each other. In later experiments, a single radiation shield surrounded the electrical resistance heated molybdenum tube. The uncorrected temperature of each wire was measured with the optical pyrometer through an opening running the length of the molybdenum tube. Failures occurred in the molybdenum tube prior to achieving 2300° C. wire optical temperature. At tungsten wire temperatures of 1920–2110° C., the observed temperature of certain experimental materials was higher. Since the two wires are physically close together (-4mm), they are at about the same actual temperature. The higher observed brightness temperature is attributed to a higher emissivity of the experimental material.

To contain the molybdenum tube, a stainless steel vacuum retort was constructed. The retort is evacuated to a pressure less than $10^{-6}$ Torr and backfilled with high purity nitrogen gas. The evacuation system includes an Alcatel Crystal 63 diffusion pump and a mechanical pump. Pressure is measured with a Granville-Phillips GP-270-002 Ionization Gauge. Electrical posts are located approximately 3 inches apart. Visible sightings are made through two sight ports.

Hafnium-tantalum alloys used for certain experimental filaments were prepared by nonconsumable electrode arc-melting and the resulting "pancake" ingots were about ¼ inch thick by 2¼ inches in diameter. Thin vertical sections about 0.035 inch to 0.048 inch thick were cut perpendicular to the plane of the "pancake" ingot. These sections were cold rolled typically to 15% to 35% reduction in thickness each time before annealing.

After finish rolling to approximately 0.010 inch thickness, 3 inch long ribbons about 0.035 inch wide were slit for use as filaments. The repeated rolling/annealing sequence demonstrated the fabricability of a range of hafnium-tantalum alloys.

DETAILED DESCRIPTION OF THE PREFERRED EMBODIMENTS

Incandescent lamp filaments are composed of tungsten because it is strong, able to perform at temperatures up to 2675° C. and above, yet emit some visible light. Tungsten has fabricability, a high melting point and relatively low vaporization, thus allowing operation at such temperature. However, a small percentage of the energy emitted by a tungsten filament is visible. The rest is infrared and ultraviolet and, therefore, not visible.

The invention involves utilizing nitrided hafnium which is a material with high emissivity within the visible light spectrum. A layer, at least partially hafnium, is formed at least on the surface of the filament. The layer is not a simple coating. Instead, it involves a nitrided reaction in place. The diameter or thickness of the filament is generally between 1 and 3 mils.

The surface layer has high emissivity in the visible light spectrum. This results in a higher visible brightness at any temperature. For example, hafnium nitride has a spectral emissivity of 0.83 at a 650 nanometer wave length at temperatures between 825° C. and 1,725° C.

The wave length of 650 nanometers is exemplary within the visible spectrum of 380 to 760 nanometers. The emissivities do not change appreciably for higher temperatures.

Tungsten does not form stable nitrides, in nitrogen which is a typical constituent of lamps. Nitrogen was used in these experiments but other gas mixtures containing nitrogen may also be used. The amount of nitrogen typically present in lamps provides an excess of nitrogen needed to react with the experimental filaments of this invention.

A standard 100 watt incandescent lamp typically has a 750 hour life with a tungsten filament operating at an actual temperature of 2675° C. Extended service lamps (1000 to 1750 hours or long life up to 20,000 hours) are produced by lowering the filament temperature (2400° C. and 2300° C. for 5000 and 20,000 hours, respectively). The necessary consequence is substantially reduced lighting efficiency as measured in lumens per watt. By utilizing nitrided hafnium, a longer life lamp with improved brightness is provided.

The surface layer of the filament will retain a high melting point.

It is preferable to heat slowly in the nitrogen environment to allow the melting point of the metallic filament to be increased before operating at the final temperature.

The nitrided hafnium will be substoichiometric, because it has less than 50% nitrogen and, as a result, will have better stability in the presence of nitrogen.

The nitriding will take place when the filament is in final shape after it is coiled, or after it is coiled for the second time. The filament is placed in an atmosphere containing nitrogen, and heated to a temperature which may be 1500° C. or higher. As a result, a nitrided surface layer is formed on the filament. Preferably the nitriding is performed at the same temperature as the operating temperature of the lamp.

The resultant filament must be stable when it is used as a lamp. That requires that at least some part of the nitriding be performed at or above a temperature close to the operating temperature of the filament.

Unlike tungsten, stoichiometric hafnium nitride does not have a low vapor pressure at high temperatures. Vaporization results in darkening of the inside of the lamp and the resulting lumen depreciation would be very undesirable. However, the approach employed in this invention consists of nitriding metallic hafnium or a hafnium containing material which produces a substoichiometric (less than 50 atomic % nitrogen) nitride with lower vapor pressure.

It was recognized that nitriding would desirably raise the melting point of the filament. Hafnium metal melts at 2227° C. and hafnium nitride melts at 3310° C. However, it was surprising that this ceramic material would conduct electricity well at room and elevated temperature and as a lamp filament be able to survive the extreme thermal shock associated with repeated on-off power cycles.

Because of the lack of coil winding equipment, lamps were made with vertical, U-shaped filaments approximately 2⅞ inch long. This was used as a screening test and better life performance is expected with more favorable geometry such as coiled wire 1 to 3 mils in diameter. A 5 mil nitrided hafnium filament G25 lamp was run with repeated on-off cycles for 7 hours at 2280° C. until failure (all temperatures are uncorrected optical measurements, actual temperatures are about 375° C.) higher. No deposits were noticed on the inside surface of the lamp. In another example, a 3 mil ribbon was made by rolling wire and used as a filament. Unlike tungsten, hafnium is readily fabricated at room temperature because it is highly ductile. The nitrided hafnium was run with repeated on-off cycles for 89 hours at 2150° C. with no failure. Lumen reduction was determined by comparing the initial lumen output with such output measured periodically during the life test. In all cases, the lamp life test is interrupted and the lumen output measured in the photometric sphere. After 89 hours at 2150° C., no lumen depreciation occurred, thus confirming the low vaporization of nitrided hafnium for use in lamps.

The desired high emissivity in the visible range demonstrated by nitrided hafnium can also be employed by using nitrided hafnium-tantalum alloys. All compositions within this metallic system are single phase solid solutions and highly fabricable. A range of alloys containing 80, 60, 45, 40, 30 and 20 weight % hafnium were melted and fabricated to 10 mil ribbon. The nitrided U-shaped filaments were tested in lamps with at least one on-off cycle per day. The following table reports lumen depreciation data for several unfailed 10 mil ribbon filaments compared to tungsten.

| Filament | Lamp Shape | Temperature (°C.) | Time (Hr.) | Lumen Depreciation (% lumens/watts) |
|---|---|---|---|---|
| Ta-20 Hf | G30 | 2280 | 686 | 4.6 |
| Ta-45 Hf | P30 | 2300 | 500 | 14.50 |
| Ta-45 Hf | P30 | 2150 | 708 | 5.0 |
| W | P30 | 2300 | 631 | 5.1 |

"G" and "P" are commercial designations of shapes. G shaped lamps are soda lime glass and P shaped lamps are borosilicate glass.

Analyses showed that the hafnium reacts substantially with the nitrogen. After operating as a hafnium wire filament in a lamp at 1650° C. (uncorrected optical temperature) for 12.5 hours, the chemical analysis was 4.7 weight % nitrogen, a very significant atomic % nitrogen. The hafnium wire is soft (273 VPN, 50g), but hardens substantially upon nitriding. A hafnium ribbon approximately 0.003 inches by 0.038 inches by 2⅞ inches long was operated in a nitrogen atmosphere lamp for 101 hours at 2150° C. (uncorrected optical temperature). The microhardness measured on a cross section from the center of the U-bend was:

| Distance from surface (Micrometers) | Microhardness (VPN) (25 gram load) |
|---|---|
| 7 | 1783 |
| 19.5 | 1748 |
| 39 (center) | 1620 |

The experimental procedure for evaluating comparative brightness temperatures that are a measure of emissivity have been described. Whereas, the actual temperatures of the closely coupled samples are very similar when heated in a nitrogen atmosphere, the difference in temperature indicates the increase in brightness temperature of the experimental material compared to tungsten in the following examples, where the optical temperature is given in °C.

| Test No. | Tungsten | Hafnium | Difference in T |
|---|---|---|---|
| 1 | 1920 | 2000 | 80 |
| 2 | 1860 | 1960 | 100 |
| 3 | 2090 | 2160 | 70 |

These and additional experiments involved hafnium and tungsten in various wire and ribbon forms and the hafnium consistently exhibited significantly higher brightness temperature. Also, the difference in brightness temperature would be even greater at higher temperature.

Ten mil ribbons of hafnium-tantalum alloy were also compared to tungsten in brightness temperature in a nitrogen atmosphere. A nitrided 20% hafnium-80% tantalum alloy had a difference in temperature of 20° C. compared to a tungsten filament at 1910° C. A nitrided 60% hafnium - 40% tantalum alloy had a difference in temperature of 60° C. compared to a tungsten filament at 2070° C.

In two tests, nitrided tantalum exhibited a 20° C. and 30° C. difference in compared to tungsten at 2060° C. Microhardness tests on cross sections of nitrided tantalum and titanium showed that both materials were substantially nitrided. However, a nitrided titanium filament in a lamp resulted in substantial volatilization and darkening of the lamp and such material is not a useful high temperature filament. Nitrided zirconium exhibited a 20° C. difference in temperature compared to tungsten at 2090° C.

Only nitrided hafnium and nitrided hafnium alloys produce the desired higher brightness temperatures compared to tungsten.

Another embodiment involves use of a hafnium clad tantalum wire. Such wire is produced by fitting a hollow hafnium cylinder around a tantalum rod and fabricating to wire. Welding at the ends will ensure maintaining close contact. Interdiffusion between hafnium and tantalum will enhance bonding. The hafnium at the surface will be stabilized upon nitriding.

Another embodiment involves the physical or chemical deposition of hafnium or hafnium-tantalum on a high temperature substrate such as tungsten or tantalum followed by nitriding. Use of a tantalum substrate has the advantage that a single phase interdiffusion zone forms at high temperature thus increasing bond strength.

Another embodiment involves the use of a coating of hafnium or hafnium-tantalum alloy on a high temperature substrate such as tungsten or tantalum followed by nitriding. Fine metallic powder is dispersed in an appropriate liquid vehicle and the filament is coated by dipping the filament into a slurry or by other coating methods The coated filament is then dried and fired to densify the coating and bond it to the substrate.

A further embodiment utilizes a tungsten-based alloy containing up to 10% hafnium. At high temperatures, the hafnium will diffuse to the surface where it will react with nitrogen to form the desired nitrided phase. This approach is different from strengthening of the tungsten filament by incorporating nitride particles by powder metallurgy techniques.

Tungsten alloys are difficult to produce and fabricate because of the brittle nature of the material until it is worked into fine wire by thermomechanical methods. During this investigation, successful powder metallurgy techniques were developed to produce satisfactory tungsten-3% hafnium material by the following procedures:

(a) Pretreat 3 to 4 micron particle size tungsten in dry hydrogen at 850° C. for one hour.

(b) Blend tungsten and hafnium powder and isostatically compact at 80,000 psi.

(c) Sinter in dry hydrogen at 2100° C. to 2150° C. for three hours.

The alloy produced by such techniques was not fabricated to wire.

What has been described therefore is an improved filament composed in part of nitrided hafnium, which is substantially more efficient than currently available filaments.

I claim:

1. An incandescent lamp filament having a substoichiometric nitrided surface layer containing at least about 20% by weight hafnium exhibiting an emissivity in the visible light spectrum substantially higher than that of tungsten.

2. The filament of claim 1, being composed of hafnium.

3. The filament of claim 1, being composed of a hafnium alloy.

4. The filament of claim 1, being composed of a hafnium-tantalum alloy.

5. The filament of claim 1, being composed of hafnium clad tantalum.

6. The filament of claim 1, being made by the process of depositing hafnium on a high temperature substrate.

7. The filament according to claim 6, wherein said deposition is physical.

8. The filament according to claim 6, wherein said deposition is chemical.

9. The filament according to claim 6, wherein said substrate is principally tungsten.

10. The filament according to claim 6, wherein said substrate is principally tantalum.

11. The filament of claim 1, being made by the process of depositing hafnium-tantalum on a high temperature substrate.

12. The filament according to claim 11, wherein said deposition is physical.

13. The filament according to claim 11, wherein said deposition is chemical.

14. The filament according to claim 11, wherein said substrate is principally tungsten.

15. The filament according to claim 11, wherein said substrate is principally tantalum.

16. The filament of claim 1, being made by the process of depositing a coating on a high temperature substrate.

17. The filament of claim 16, wherein said coating is principally hafnium.

18. The filament according to claim 17, wherein said substrate is principally tungsten.

19. The filament according to claim 17, wherein said substrate is principally tantalum.

20. The filament of claim 16, wherein said coating is hafnium-tantalum.

21. The filament according to claim 20, wherein said substrate is tungsten.

22. The filament according to claim 20, wherein said substrate is tantalum.

23. The process for making an incandescent lamp filament of claim 1, comprising depositing hafnium-tantalum on a high temperature substrate.

24. The process for making an incandescent lamp filament according to claim 23, wherein said deposition is physical.

25. The process for making an incandescent lamp filament according to claim 23, wherein said deposition is chemical.

26. The process for making an incandescent lamp filament according to claim 23, wherein said substrate is tungsten.

27. The process for making an incandescent lamp filament according to claim 23, wherein said substrate is tantalum.

* * * * *